US007219519B1

(12) United States Patent
Shen

(10) Patent No.: US 7,219,519 B1
(45) Date of Patent: May 22, 2007

(54) CYLINDER HOUSING FOR AUXILIARY LOCK

(75) Inventor: Mu-Lin Shen, Tainan (TW)

(73) Assignee: I-Tek Metal Mfg. Co. Ltd, Tainan (TW)

( * ) Notice: Subject to any disclaimer, the term of this patent is extended or adjusted under 35 U.S.C. 154(b) by 0 days.

(21) Appl. No.: 11/306,403

(22) Filed: Dec. 27, 2005

(51) Int. Cl.
*E05B 9/08* (2006.01)

(52) U.S. Cl. ..... 70/451; 70/371; 70/373; 70/449

(58) Field of Classification Search ..... 70/370, 70/371, 373, 448–452
See application file for complete search history.

(56) References Cited

U.S. PATENT DOCUMENTS

| | | | | |
|---|---|---|---|---|
| 3,514,983 | A | 6/1970 | Krook et al. | 70/370 |
| 3,550,411 | A | 12/1970 | Neary et al. | 70/370 |
| 4,272,974 | A | 6/1981 | Hennessy | 70/129 |
| 4,338,804 | A | 7/1982 | Solovieff | 70/134 |
| 4,548,061 | A | 10/1985 | Nilsson | 70/370 |
| 4,841,754 | A | 6/1989 | Jones | 70/207 |
| 5,010,749 | A | 4/1991 | Lin | 70/190 |
| 5,186,030 | A | 2/1993 | Lin | 70/190 |
| 5,216,910 | A | 6/1993 | Lin | 70/370 |
| 5,335,525 | A * | 8/1994 | Solovieff | 70/370 |
| 5,713,231 | A * | 2/1998 | Shen | 70/370 |
| 5,722,273 | A | 3/1998 | Lin | 70/370 |
| 5,881,590 | A * | 3/1999 | Small | 70/370 |
| 5,906,125 | A | 5/1999 | Shen | 70/370 |
| 6,230,528 | B1 * | 5/2001 | Don et al. | 70/370 |
| 6,691,538 | B1 * | 2/2004 | Yang et al. | 70/370 |
| 6,840,070 | B1 * | 1/2005 | Huang et al. | 70/370 |
| 6,840,073 | B2 * | 1/2005 | Huang et al. | 70/370 |
| 6,857,297 | B1 * | 2/2005 | Ruan | 70/370 |

FOREIGN PATENT DOCUMENTS

GB 2200680 A * 8/1988

* cited by examiner

*Primary Examiner*—Suzanne Dino Barrett
*Assistant Examiner*—Christopher Boswell
(74) *Attorney, Agent, or Firm*—Alan Kamrath; Kamrath & Associates, PA

(57) ABSTRACT

A cylinder housing includes a longitudinal hole for receiving a cylinder of an auxiliary lock. An annular flange is formed on an end of an outer circumference of the cylinder housing, leaving an annular end portion on the end of the cylinder housing. The cylinder housing is mounted to an outer surface of a door having a bore-hole, with the end portion being in intimate contact with a circumferential surface delimiting the bore-hole of the door, and with the annular flange intimately abutting against the outer surface of the door.

6 Claims, 3 Drawing Sheets

CYLINDER HOUSING FOR AUXILIARY LOCK

BACKGROUND OF THE INVENTION

1. Field of the Invention

The present invention relates to a cylinder housing for an auxiliary lock. More particularly, the present invention relates to a cylinder housing for a cylinder of an auxiliary lock. The present invention also relates to an auxiliary lock with such a cylinder housing.

2. Description of the Related Art

U.S. Pat. No. 5,906,125 discloses an auxiliary lock comprising a ring having a central opening and a first flange received in a door bore-hole, a cylinder housing having a shoulder abutting the ring and a hollow protrusion extending into the central opening of the ring, the hollow protrusion having a flat outer wall, a trim enclosing over the cylinder housing, and a cylinder having a rear end received within the hollow protrusion of the cylinder housing and a shoulder abutting the trim, the flat outer wall of the protrusion being intimately interposed between the ring and the rear end of the cylinder. The cylinder housing and the trim are retained in a fixed relationship with respect to the door. The ring further includes a second flange, and a free end of the trim adjacent to the shoulder of the cylinder housing is situated between the shoulder of the cylinder housing and the second flange of the ring. The trim, when rotated by an external force, will rotate with respect to the ring but not drive the cylinder housing to rotate, therefore the auxiliary lock will not be damaged.

However, an intruder can still destroy the auxiliary lock by breaking the coupling section between the elements, such as the coupling section between the ring and the trim. The ring would no longer protect the cylinder after the elements are separated from one another after destruction. Further, the auxiliary lock of this type is complicated in structure and, thus, has a higher cost due to troublesome assembling.

SUMMARY OF THE INVENTION

In accordance with an aspect of the present invention, a cylinder housing is provided for a cylinder of an auxiliary lock. The cylinder housing comprises a longitudinal hole adapted for receiving a cylinder of an auxiliary lock. An annular flange is formed on an end of an outer circumference of the cylinder housing, leaving an annular end portion on the end of the cylinder housing. The cylinder housing is adapted to be mounted to an outer surface of a door having a bore-hole, with the end portion being in intimate contact with a circumferential surface delimiting the bore-hole of the door and with the annular flange intimately abutting against the outer surface of the door.

In accordance with another aspect of the invention, an auxiliary lock comprises a cylinder and a cylinder housing rotatably mounted around the cylinder, an annular flange being formed on an end of an outer circumference of the cylinder housing, leaving an annular end portion on the end of the cylinder housing. The cylinder housing is adapted to be mounted to an outer surface of a door having a bore-hole, with the end portion being in intimate contact with a circumferential surface delimiting the bore-hole of the door and with the annular flange intimately abutting against the outer surface of the door.

Preferably, the cylinder housing further comprises two annular stepped portions respectively formed on two ends of a circumferential wall delimiting the longitudinal hole of the cylinder housing. The cylinder further comprises two annular shoulders respectively abutting against the annular stepped portions of the cylinder housing.

Preferably, the cylinder is completely received in the cylinder housing.

Preferably, the end portion of the cylinder housing is tightly sandwiched between the end of the outer circumference of the cylinder and the circumferential surface delimiting the bore-hole of the door, enhancing anti-destruction effect.

After mounting the auxiliary lock on the door, damage to the cylinder would not be easy to achieve, as the cylinder is fittingly received in the cylinder housing. Further, it is not easy to clamp the cylinder housing with a pair of pliers or the like, as the end portion of the cylinder housing is received in the bore-hole of the door and as the cylinder housing is rotatably mounted around the cylinder. In a case that an intruder is intended to destroy the auxiliary lock by hammering the cylinder housing with a hammer or the like, the impact to the cylinder housing can be evenly released to the door, thereby reducing the destructive force. Further, since the first annular shoulder of the cylinder abuts against the annular first stepped portion of the cylinder housing and the second annular shoulder of the cylinder abuts against the annular second stepped portion of the cylinder housing, the cylinder housing is capable of withstanding outward pulling force applied by an intruder.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
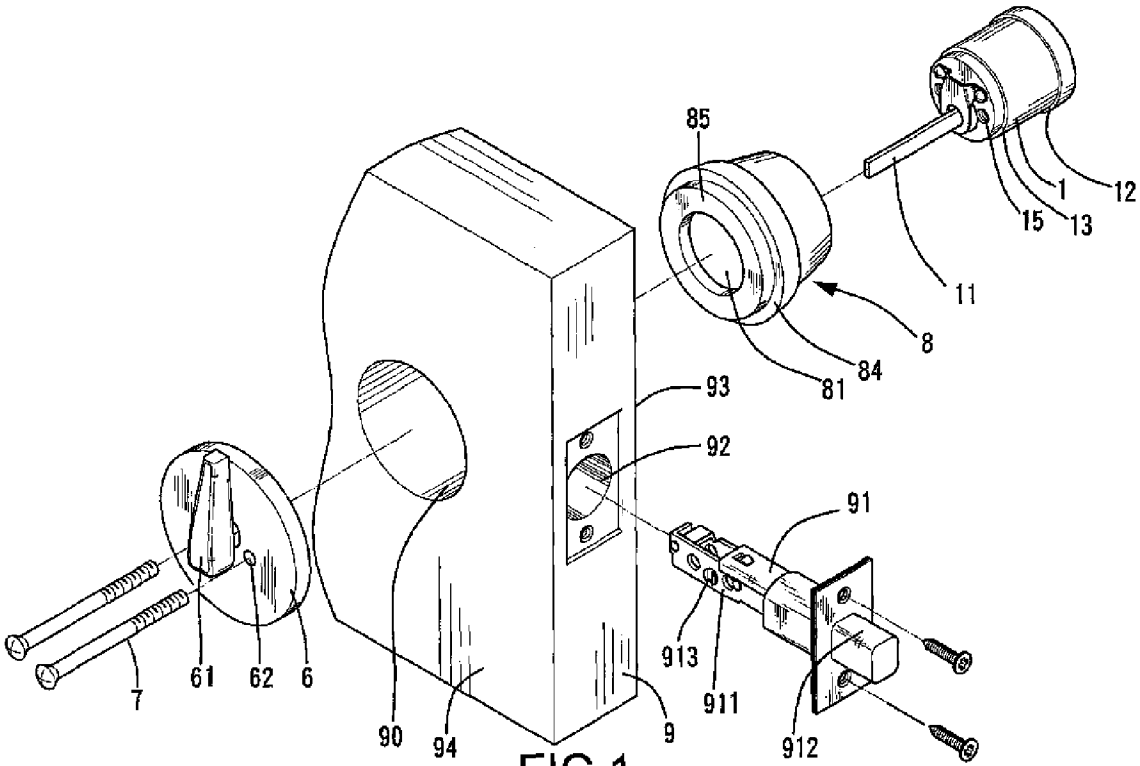
FIG. 1 is an exploded perspective view of a portion of a door and an auxiliary lock in accordance with the present invention.
Figure 2:
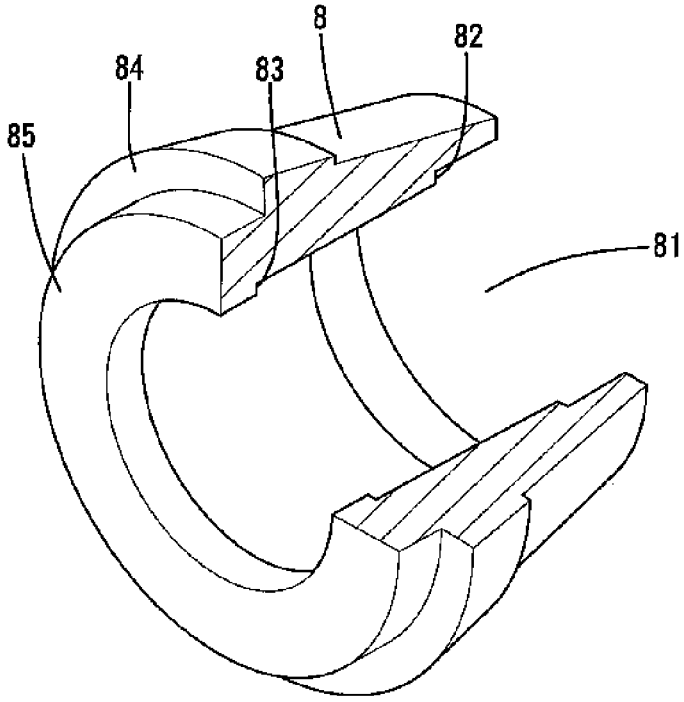
FIG. 2 is a perspective view of a cylinder housing of the auxiliary lock in accordance with the present invention.
Figure 3:
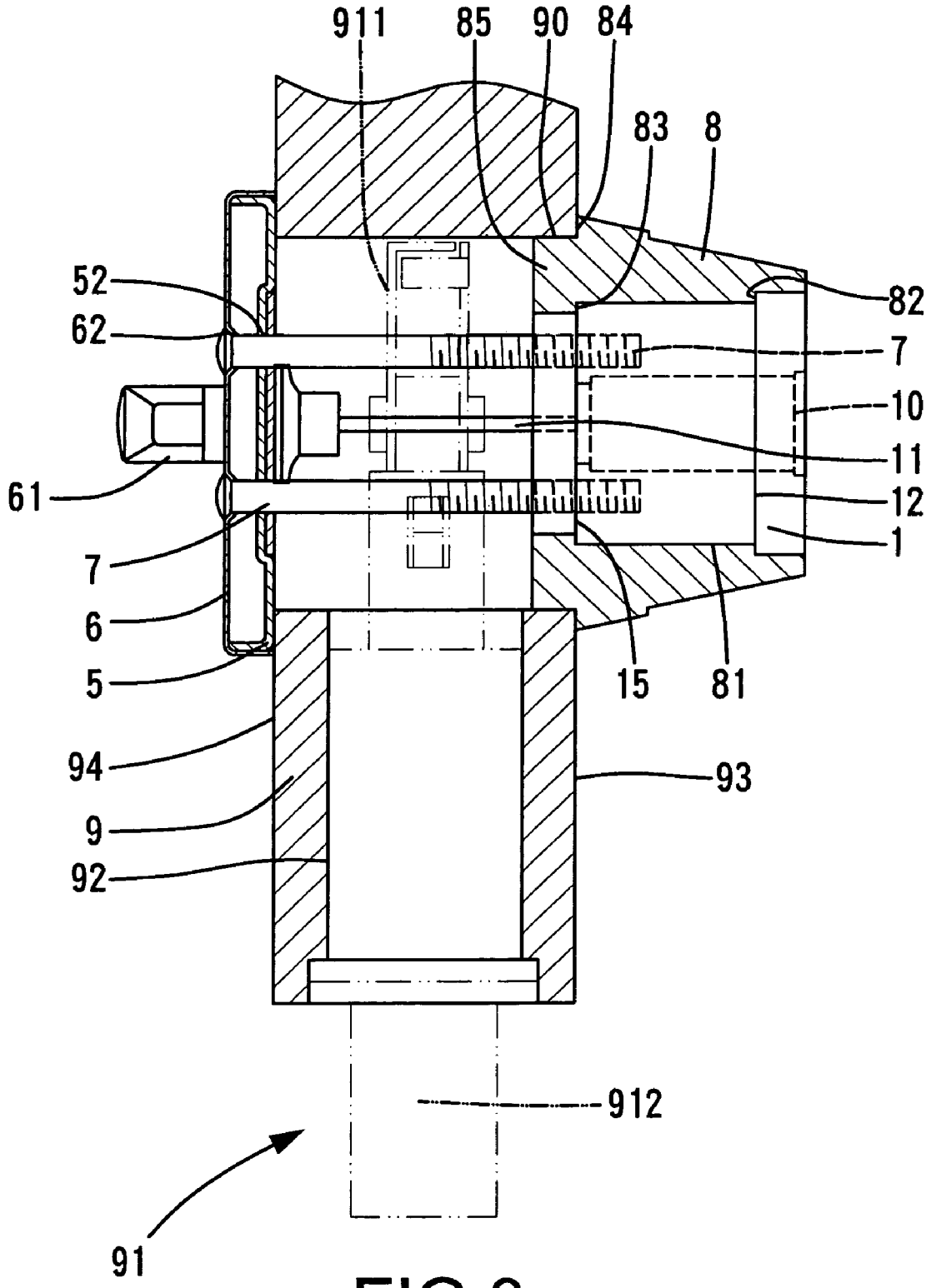
FIG. 3 is a sectional view of the door and the auxiliary lock in accordance with the present invention after assembly.

Referring to FIGS. 1 through 3, an auxiliary lock in accordance with the present invention comprises a cylinder 1 and a cylinder housing 8. The cylinder 1 comprises a tailpiece 11 and mounted on an outer surface 93 of the door 9. The cylinder housing 8 is also mounted on an outer surface 93 of the door 9 and receives the cylinder 1.

The cylinder 1 includes a lock core 10 mounted therein. A first annular shoulder 12 is formed on an end of the circumference of the cylinder 1 that is distal to the door 9 after assembly. Further, a second annular shoulder 13 is formed on the other end of the circumference of the cylinder 1 that is adjacent to the door 9 after assembly.

In this example, the auxiliary lock further comprises a first engaging plate 5 fixed to an inner side 94 of the door 9, a second engaging plate 6, and a bolt mechanism 91. The first engaging plate 5 and the second engaging plate 6 are securely fixed together and then securely fixed to the cylinder 1 by, e.g., extending two screws 7 through holes 62, 52, and 15 respectively in the second engaging plate 6, the first engaging plate 5, and the cylinder 1. A knob 61 is pivotally mounted to the second engaging plate 6 to allow manual locking or unlocking.

The bolt mechanism 91 comprises a retractor 911 mounted in an opening 92 in an edge face of the door 9 and a bolt 912 connected to the retractor 911. The tailpiece 11 of the cylinder 1 is extended through a hole 913 in the retractor 911 and coupled to the knob 61. When the knob 61 is turned or a key (not shown) is inserted into the lock core 10 and turned to actuate the tailpiece 11, the retractor 911 is moved to retract or extend the bolt 912, which is conventional.

Referring to FIG. 2, the cylinder housing 8 comprises a longitudinal hole 81 for receiving the cylinder 1. Preferably, the cylinder 1 is completely received in the cylinder housing 8. An annular, first, stepped portion 82 and an annular, second, stepped portion 83 are respectively formed on a first, front end and a rear, second end of a circumference wall delimiting the longitudinal hole 81. When the cylinder 1 is mounted into the longitudinal hole 81 of the cylinder housing 8, the first annular shoulder 12 of the cylinder 1 abuts against the annular, first, stepped portion 82 of the cylinder housing 8 and the second annular shoulder 13 of the cylinder 1 abuts against the annular, second, stepped portion 83 of the cylinder housing 8, as shown in FIG. 3. The cylinder 1 is, thus, fittingly received in the cylinder housing 8.

The cylinder housing 8 further comprises an annular flange 84 on a front end of an outer circumference of the cylinder housing 8, leaving an annular end portion 85 on the front end of the cylinder housing 8. The end portion 85 has an outer diameter substantially the same as or slightly smaller than a diameter of the bore-hole 90 of the door 9. Thus, when the end portion 85 of the cylinder housing 8 is inserted into the bore-hole 90 of the door 9 for installation purposes, the end portion 85 is in intimate contact with a circumferential surface delimiting the bore-hole 90, with the annular flange 84 abutting against the outer surface 93 of the door 9.

Referring to FIG. 3, after mounting the auxiliary lock on the door 9, the cylinder 1 is fittingly received in the cylinder housing 8 and fixedly engaged with the first and second engaging plates 5 and 6 by the screws 7. Damage to the cylinder 1 would not be easy to achieve. Since the end portion 85 of the cylinder housing 8 is annular and received in the bore-hole 90 of the door 9, the cylinder housing 8 is rotatably mounted around the cylinder 1. Hence, it is not easy to clamp the cylinder housing 8 with a pair of pliers or the like. In a case that an intruder is intended to destroy the auxiliary lock by hammering the cylinder housing 8 with a hammer or the like, the impact to the cylinder housing 8 can be evenly released to the door 9, thereby reducing the destructive force. Further, since the first annular shoulder 12 of the cylinder 1 abuts against the annular, first, stepped portion 82 of the cylinder housing 8 and the second annular shoulder 13 of the cylinder 1 abuts against the annular, second, stepped portion 83 of the cylinder housing 8, the cylinder housing 8 is capable of withstanding outward pulling force applied by an intruder.

The end portion 85 of the cylinder housing 8 can be as long as possible without adversely affecting assembling/mounting of the bolt mechanism 91 of the auxiliary lock. As a result, the cylinder housing 8 can be firmly engaged on the outer surface 93 of the door 9, with the cylinder 1 fittingly received in the cylinder housing 8 and with the end portion 85 tightly sandwiched between the front end of the outer circumference of the cylinder 1 and the circumferential surface delimiting the bore-hole 90 of the door 9. The anti-destruction effect is enhanced.

It is noted that the first and second engaging plates 5 and 6 can be replaced with other structures, such as another set of cylinder 1 and cylinder housing 8 in accordance with the present invention.

Although specific embodiments have been illustrated and described, numerous modifications and variations are still possible without departing from the essence of the invention. The scope of the invention is limited by the accompanying claims.

What is claimed is:

1. An auxiliary lock comprising:

a cylinder;

a cylinder housing rotatably mounted around the cylinder, an annular flange being formed on an end of an outer circumference of the cylinder housing, leaving an annular end portion on the end of the cylinder housing; and a bolt mechanism in operable connection to the cylinder;

with the cylinder housing being adapted to be mounted to an outer surface of a door having a bore-hole, with the end portion being in intimate contact with a circumferential surface delimiting the bore-hole of the door and with the annular flange intimately abutting against the outer surface of the door;

with the cylinder housing including a longitudinal hole in which the cylinder is mounted, with the cylinder housing further comprising two annular stepped portions respectively formed on two ends of a circumferential wall delimiting the longitudinal hole of the cylinder housing, with the cylinder further comprising two annular shoulders respectively contacting the annular stepped portions of the cylinder housing, with the cylinder housing being freely rotatable relative to the cylinder and the bolt mechanism operably connected to the cylinder.

2. The auxiliary lock as claimed in claim 1 wherein the cylinder is completely received in the cylinder housing.

3. The auxiliary lock as claimed in claim 1 wherein the end portion of the cylinder housing is tightly sandwiched between the end of the outer circumference of the cylinder and the circumferential surface delimiting the bore-hole of the door.

4. The auxiliary lock as claimed in claim 1 further comprising:

an engaging plate; and at least one screw extending through the engaging plate, passing through the longitudinal hole of the cylinder housing, and threadably received in the cylinder, with the cylinder housing being freely rotatable relative to the engaging plate and the at least one screw.

5. The auxiliary lock as claimed in claim 4 wherein the cylinder is completely received in the cylinder housing.

6. The auxiliary lock as claimed in claim 4 wherein the end portion of the cylinder housing is tightly sandwiched between the end of the outer circumference of the cylinder and the circumferential surface delimiting the bore-hole of the door.

* * * * *